United States Patent [19]

O'Donnell

[11] Patent Number: 4,779,801

[45] Date of Patent: Oct. 25, 1988

[54] APPARATUS AND PROCESS FOR REMOVING SMOKE FROM BURNING BUILDINGS

[76] Inventor: James W. O'Donnell, 7400 N. Overhill, Chicago, Ill. 60648

[21] Appl. No.: 932,349

[22] Filed: Nov. 19, 1986

Related U.S. Application Data

[63] Continuation-in-part of Ser. No. 856,203, Apr. 28, 1986, Pat. No. 4,703,808.

[51] Int. Cl.[4] ..... A62C 39/00

[52] U.S. Cl. ..... 239/276; 239/280; 169/91

[58] Field of Search ..... 169/43, 46, 91, 51, 169/70; 248/67.5, 74.5, 75, 216.1, 217.3; 239/271, 272, 276, 280, 531, 532, 428.5; 98/42.03, 42.05

[56] References Cited

U.S. PATENT DOCUMENTS

| | | | |
|---|---|---|---|
| 2,120,563 | 6/1938 | Lamb | 169/91 X |
| 2,910,711 | 11/1959 | Mizelle | 239/280 X |
| 3,780,911 | 12/1973 | Yao | 169/91 X |

*Primary Examiner*—Andres Kashnikow
*Assistant Examiner*—Kevin Patrick Weldon
*Attorney, Agent, or Firm*—Thomas W. Tolpin

[57] ABSTRACT

A special, lightweight, easy-to-use apparatus and effective smoke abatement process are provided to efficiently remove smoke and gases from a burning building to minimize smoke damage, asphyxiation, and injury, as well as to accommodate safer quicker exiting of the building's occupants and better visibility for the firemen. The apparatus has a water spray nozzle which is positioned to face away from the fire to create a suction which draws the smoke and gases out of the burning building.

7 Claims, 3 Drawing Sheets

FIG-8-
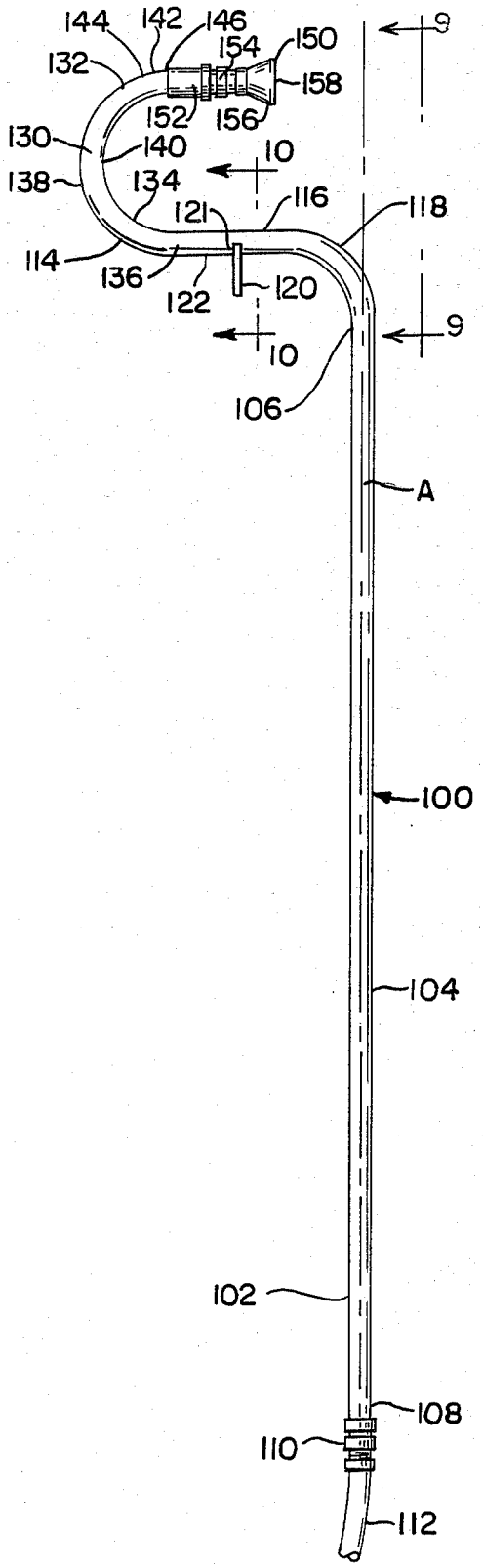
FIG-9-
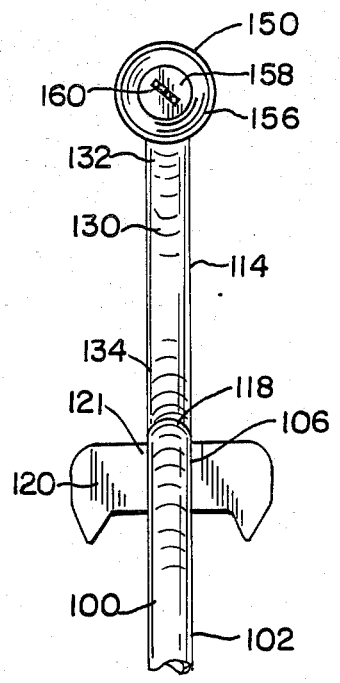
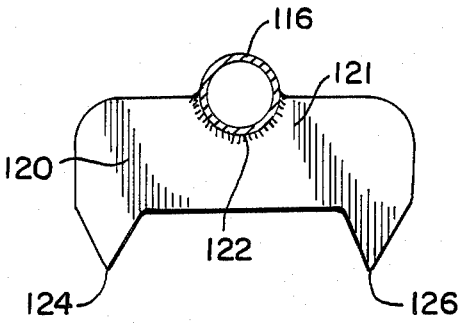
FIG 10-

APPARATUS AND PROCESS FOR REMOVING SMOKE FROM BURNING BUILDINGS

RELATED APPLICATIONS

This patent application is a continuation-in-part of the patent application of James W. O'Donnell for a Smoke Eliminator, serial no. 856,203, filed April 28, 1986, now patent no. 4,703,808.

BACKGROUND OF THE INVENTION

This invention relate to firefighting equipment and, more particularly, to an apparatus and process for removing smoke from burning buildings.

Fires in burning buildings emit enormous amounts of smoke. Smoke from billowing flames and the combustion of household, school and office furnishings, such as wooden desks, tables, drapes, upholstery, synthetic backed carpeting, rubber coated electrical wires, wallpaper, polyvinyl chloride and other plastics, latex paint, and oil based paint emit noxious soot-laden toxic gases, such as carbon monoxide, hydrogen sulfide, sulfur oxides, nitrogen oxides, hydrogen, nitrogen, and ammonia.

Such smoke can be hazardous, injurous to the health and safety of the building's occupants and firefighting personnel. Smoke can quickly blanket areas surrounding the fire and asphyxiate its occupants and firefighting personnel. Many government reports indicate that many victims of fire die from smoke asphyxiation rather than from the heat or flames of the fire.

Clouds and heavy concentrations of smoke can impair the vision of firemen and impede their progress in extinguishing the fire. Furthermore, smoke often causes substantial property damage to clothing, drapes, upholstery, carpeting, wallpaper, and other furnishings in buildings.

Over the years various types of equipment have been suggested for extinguishing fires and removing smoke. Fans have been suggested for removing smoke, but they are usually unreliable, cumbersome and awkward. Fans often fail because their electric motor and wires are melted from the heat generated by the flames. Fans are also difficult to mount near a window of a burning building. Pistol grip, hand-held fog nozzles have been used by firemen inside burning building but smoke, gas and heat often impair the fireman's abilaty to efficiently use the nozzles.

Typifying some of the prior art firefighting equipment and other types of devices are those shown in U.S Pat. Nos. 2,017,369; 3,888,535; 4,319,851; and 4,502,806. Such prior art fire fighting equipment and other devices have met with varying degrees of success.

It is, therefore, desirable to provide an improved apparatus and process for removing smoke from a burning building.

SUMMARY OF THE INVENTION

An improved apparatus and process is provided to help remove smoke, gases, and heat from a burning building. Advantageously the novel apparatus and process is efficient economical, and effective. The novel apparatus and process can save many lives and greatly reduce property damage. Desirably, the novel apparatus and process are simple to operate and easy to use.

To this end, the novel apparatus has an elongated conduit, pipe, or tube which is adapted to be positioned upwardly against the outer exterior wall of a burning building. An outlet nozzle is operatively connected to the conduit, pipe or tube for positioning in an opening of a window or door of the burning building. The nozzle has a spray head which faces in a direction transverse to the axis of the elongated conduit, pipe, or tube and when installed is positioned to face away from the flames toward the outside of the building. In the preferred form, the nozzle comprises a fog nozzle and a C-shaped tubular neck or curved conduit extends between and connects the fog nozzle to the top of the elongated conduit, pipe, or tube for best results In the novel process, a stream of water is directed out of the building opening to create a vacuum or negative pressure and suction which withdraws (sucks out) the smoke, gases, and a substantial amount of heat. Preferably, the water is sprayed and diffused in a diverging spray pattern. Desirably, the water is also sprayed on the exterior wall of the building and adjacent buildings to cool their temperature and prevent spreading of the fire.

A more detailed explanation of the invention is provided in the following description and claims taken in conjunction with the accompanying drawings.

BRIEF DESCRIPTION OF THE DRAWINGS

FIG. 8 is an enlarged side view of the smoke eliminator apparatus of FIG. 4;

FIG. 9 is an enlarged front view of the nozzle, neck, and mounting bar of the smoke eliminator apparatus taken substantially along line 9—9 of FIG. 8; and FIG. 10 is an enlarged front view of the mounting bar of the smoke eliminator apparatus taken substantially along line 10—10 of FIG. 8.

DETAILED DESCRIPTION OF THE PREFERRED EMBODIMENTS

Figure 1:
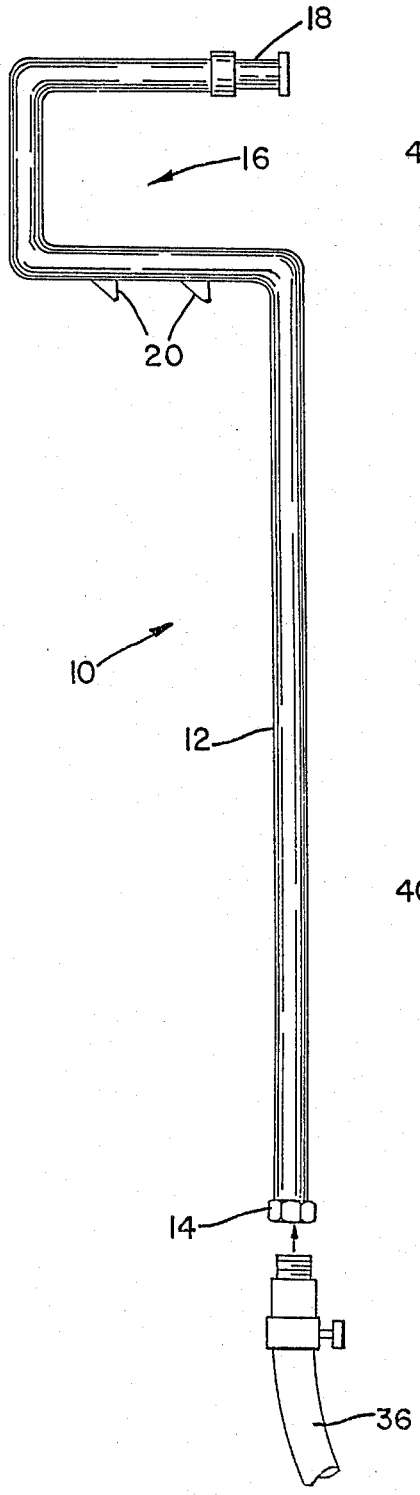
FIG. 1 is a side view of a smoke eliminator apparatus in accordance with principles of the present invention.

Referring to FIGS. 4–10 of the drawings, a smoke eliminator apparatus 100, also referred to as a smoke eliminator, provides a compact, portable, easy-to-use, dependable piece of firefighting equipment, which helps remove soot-laden smoke containing combustion gases, as well as heat, from a burning building B in an efficient and effective manner.

The combustion gases from the fire may include: carbon monoxide, hydrogen sulfide, sulfur oxides, nitrogen oxides, nitrogen, hydrogen, and light hydrocarbon gases, such as methane, ethane, propane, and butane.

The smoke eliminator apparatus can be made of aluminum or other corrosion (rust) resistant material. Other heat (fire) resistant materials can be used.

The smoke eliminator apparatus 100 has an elongated straight, rigid pipe, tube, or conduit 102 which extends vertically (FIGS. 4 and 8) or diagonally (FIG. 6) upwardly along a longitudinal or vertical axis A. The elongated pipe 102 has a manually grippable intermediate portion 104 which provides a handle to grip and position the apparatus along an exterior wall W of a burning building B. The upright pipe 102 has an upper neck-engaging, attached end portion 106 and a lower hose-engaging end portion 108. The lower hose-engaging end portion 108 has an internally threaded female coupling 110 or swivel to receive a hose 112, which is connected to a water supply, such as a water tank, hydrant, or reservoir of a firetruck via an on-off valve.

The smoke eliminator apparatus 100 also has a generally C-shaped or U-shaped, curved, bent, rigid pipe, tube, or conduit 114 (FIGS. 5,7, and 8) which provides a C-shaped neck. The C-shaped neck 114 is connected to and communicates with the upper neck-engaging end portion 106 (FIG. 8) of the upright pipe 102. The neck 114 has a horizontal, straight, lower arm 116 with a rounded, curved, upright pipe-engaging, outer, lower arm portion 118, which extends radially and horizontally inwardly from the upper neck-engaging end portion 106 of the upright pipe 102. A downward extending, generally n-shaped, mounting bar, member, or plate 120 (FIGS. 4–10) has an upper portion 121 (FIG. 10) which is welded or otherwise connected to the underside 122 of the lower arm 116. The mounting bar 120 has a pair of downwardly extending pointed edges, apexes, or spikes 124 and 126 which are positioned on transversely opposite sides of the lower arm 116. The spikes can be readily driven and wedged to securely engage and penetrate a portion of a support surface, such as a window ledge, doorsill, wall, or corners of a building opening 0 to detachably mount the smoke eliminator apparatus 100 to the burning building. The mounting bar 120 support the lower arm and apparatus upon a window ledge, doorsill, or other surface of the burning building As shown in FIG. 8, the C-shaped tubular neck 114 has a rounded arcuate bight 130 with an upper bight portion 132 and a lower bight portion 134. The lower bight portion 134 is connected to a communicates with the inward end portion 136 of the lower arm 116. The rounded bight 130 has a convex exterior outer surface 138, which faces toward the interior of the burning building, and has a concave inner surface 140, which faces towards, but is spaced inwardly of, the opening 0 of the burning building.

The C-shaped neck 114 also has a horizontal, straight, upper arm 142 with a bight-engaging inward end portion 144 which is connected to and communicates with the upper end portion 132 of the rounded bight 130. The upper arm 142 is shorter than and positioned above the lower arm 116. The upper arm 142 has an outer nozzle-engaging end portion 146 which is spaced radially and horizontally inwardly of and is offset from the longitudinal axis A of the upright pipe 102. The outer nozzle-engaging end 146 can be externally threaded.

As shown in FIGS. 8 and 9, the top portion of the eliminator apparatus 100 has an outlet spray, fog nozzle 150. The fog nozzle 150 has an annular male coupling 152, which can be internally threaded. The coupling 152 is connected to and communicates with the outer nozzle-engaging and portion 146 of the upper arm 142 of the C-shaped tubular neck 114. The nozzle 150 has an intermediate, main body portion 154 which is connected to and communicates with the coupling 152 along its inner end and an outwardly flared, diverging, annular spray head 156 along its outer end. The spray head 156 annularly and concentrically surrounds an apertured, upright, foraminous spray face 158. The spray head 156 and face 158 face outwardly towards the outside of the burning building. Preferably, for best results, the spray head 156 and face 158 are spaced (set back) radially and horizontally inwardly of the longitudinal axis A of the upright pipe 102 and the outer and portion 118 of the lower arm 116, so as to be in positioned in substantial vertical alignment with the window or door opening 0 of the burning building.

Figure 5:
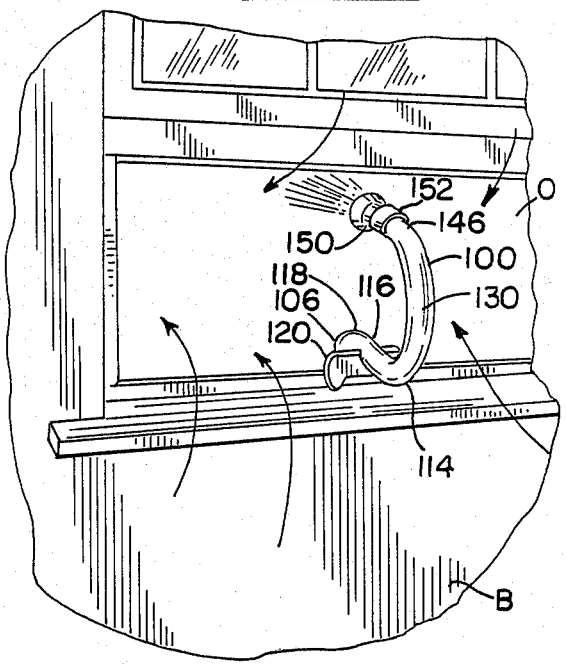
FIG. 5 is a slightly enlarged perspective back view of part of the smoke eliminator apparatus of FIG. 4 removing smoke, gases, and heat from the burning building as viewed from the inside of the building.
Figure 6:
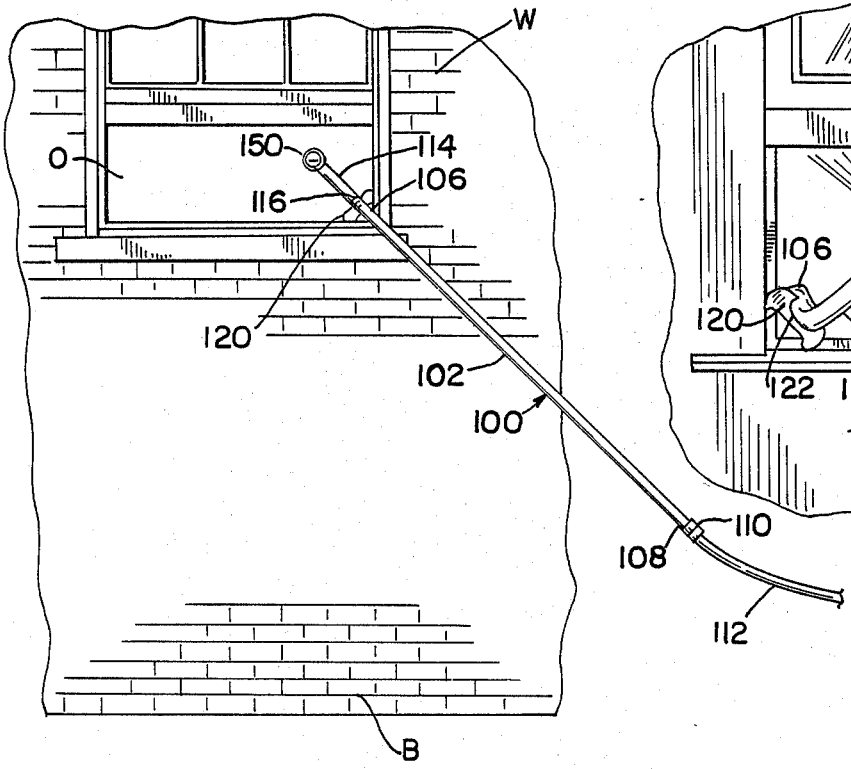
FIG. 6 is a front view of the smoke eliminator apparatus of FIG. 4 installed in the corner of the window opening as viewed from the outside of the building.
Figure 7:
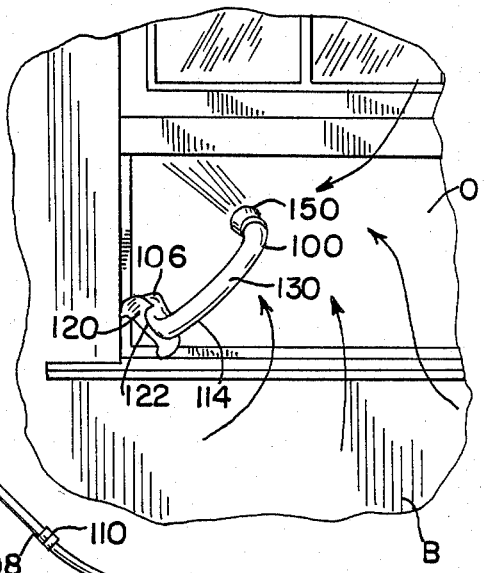
FIG. 7 is a slightly enlarged perspective back view of part of the smoke eliminator apparatus of FIG. 6 removing smoke, gases, and heat from the burning building as viewed from the inside of the building.

The face 158 of the spray head 156 communicates with the main body portion 154 of the nozzle 150 and has a set of apertures or holes 160 (FIG. 9). The apertures or holes 160 provide fluid flow outlet passageways which spray a mist of water in an outwardly diverging spray pattern in a direction exteriorly away from the opening of the burning building as shown in FIGS. 5 and 7. Desirably, the water is sprayed at a sufficient pressure and flow rate to create a negative pressure and suction to withdraw (remove) a substantial amount of smoke, soot, gases, and heat from the burning building and discharge the smoke, soot, gases, and heat through the window or door opening to the surrounding atmosphere on the outside of the building.

In use, the spray head 156 and face 158 of the fog nozzle 150 is positioned in alignment with the window or opening of a burning building in a direction towards the outside of the building. The spike 124 and 126 of the mounting bar 120, extending downwardly from the lower arm of the C-shaped neck 114, are placed upon or hammered or otherwise driven into the window ledge (FIGS. 4 and 5), window corner (FIGS. 6 and 7), or other support surface surrounding the building opening to securely position and mount the smoke eliminator apparatus 100. The C-shaped neck can be used as a hammering but to break a window, although it may be preferred to use other equipment to do so, if there is a screen, etc. The upright pipe 102 of the smoke eliminator apparatus 100 is placed in a vertical (FIG. 4) or diagonal (FIG. 6) upright direction against the exterior outer wall of the burning building. Either afterwards, or earlier, the hose 112 can be connected to the hose coupling 110 at the lower and 108 of the upright pipe. The valve of the water supply is then opened to feed and supply water to the smoke eliminator apparatus 100 to permit the nozzle 150 to inject and spray the water in an outwardly flared diverging mist. The outwardly sprayed water mist creates a negative pressure or vacuum and suction which causes the smoke, gases, soot and heat on the inside of the burning building to be withdrawn (sucked out) of the building opening into the surrounding atmosphere. The spray mist also operates as a heat curtain or heat sink to prevent the smoke from rising into upper floors and causing asphyxiation and substantial damage therein. Removal of the smoke from the interior of the building helps minimize smoke damage, asphyxiation, or other injury to the building's occupants, decreases the heat, lowers the temperature, and clears the visibility in the burning area for the firemen.

The smoke eliminator apparatus need not be held by firefighters or other personnel once it is positioned (mounted) in the window opening or door opening of the burning building. The back pressure from the water being sprayed outwardly, can also help hold the the smoke eliminator apparatus against the sides of the building opening.

In one series of tests, the smoke eliminator apparatus had a 1¼ inch diameter, upright aluminum pipe and a 1½ inch hose coupling, which was connected to a 1¼ inch hose. The upright pipe was 6 feet 2 inches long. The smoke eliminator apparatus had a 1¼ inch diameter, aluminum, C-shaped tubular neck. The neck had a maximum longitudinal span and height of 12 inches and was connected via a 1½ inch male coupling to a 1½ inch fog nozzle. The face of the nozzle was set back (spaced) 4 inches inwardly of the longitudinal axis of the upright pipe. After the window was opened, the fog nozzle was positioned in the window opening and the spikes of the mounting bar were driven into the middle portion of a window ledge of the opening to secure (mount) the smoke eliminator apparatus. When the smoke from the controlled fire completely filled the room, the water faucet valve, connected to the other end of the hose, was turned on to supply water to the smoke eliminator apparatus. Water was sprayed outwardly of the building in a fine mist by the nozzle of the smoke eliminator apparatus. After a short time, the smoke in the room was completely emptied and exited (was sucked out) through the window opening to the outside of the building.

Figure 2:
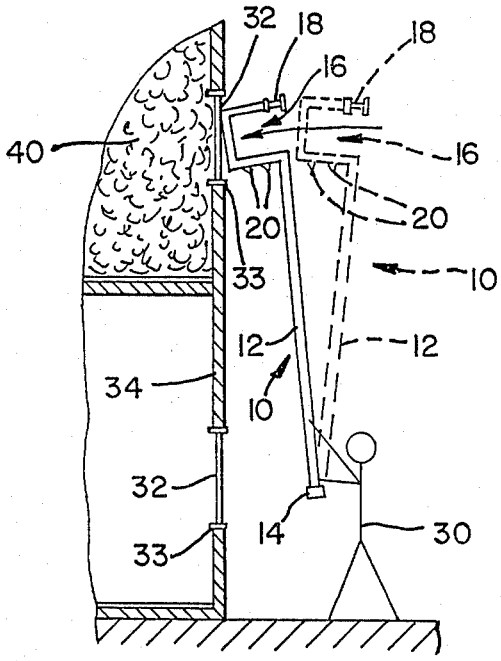
FIG. 2 is a fragmentary cross sectional view of a burning building and a schematic stick diagram of a fireman using the apparatus to break a window preparatory to mounting the apparatus, as shown in FIG. 3, for its primary use to remove smoke and gases from the burning building.
Figure 3:
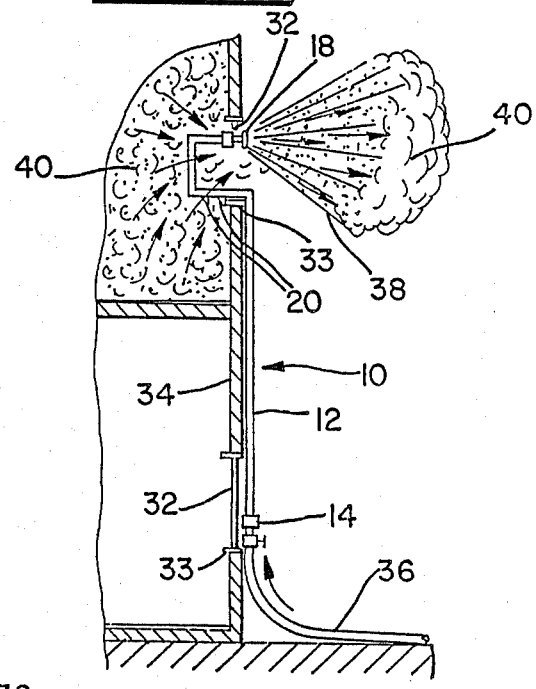
FIG. 3 is a reduced side view of the smoke eliminator apparatus connected to a hose and mounted and removing smoke from the burning building.
Figure 4:
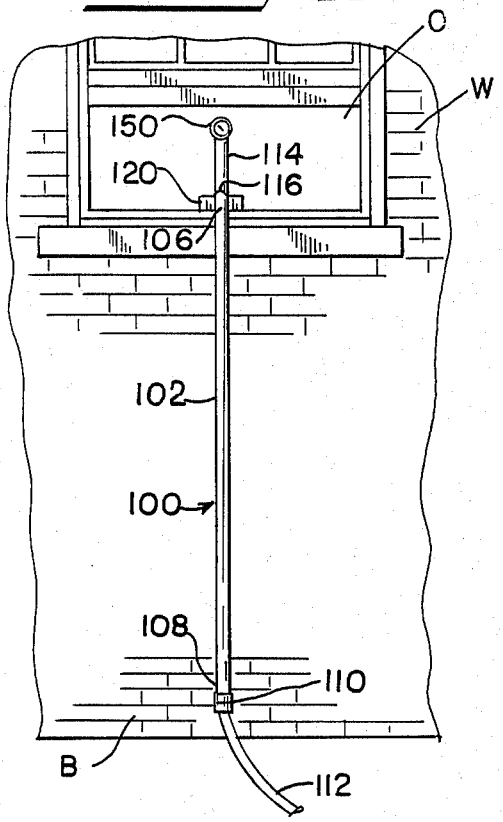
FIG. 4 is a front view of another smoke eliminator apparatus in accordance with principles of the present invention as viewed from the outside of a burning building and installed on the middle portion of a window ledge.

The smoke eliminator apparatus 10 or FIGS. 1–3, is similar in many respects to the smoke eliminator apparatus 100 of FIGS. 4–10, except: its nozzle 18 is aligned with the upright tube 12, the C-shaped tubular neck 16 is more rectangular than rounded, there are two radially spaced spikes 20 instead of an n-shaped mounting bar, and the nozzle 18 does not have an outwardly flared spray head. The smoke eliminator 10 of FIGS. 1–3 is more fully described in my parent patent application, Ser. No. 856,203, filed April 28, 1986, entitled Smoke Eliminator, which is hereby incorporated by reference in its entirety.

While the smoke eliminator apparatus 10 of FIGS. 1–3 is useful removing smoke, gases, soot, and heat from a burning building, the smoke eliminator apparatus 100 of FIGS. 4–10 is preferred for best results. Among the many advantages of the smoke eliminator apparatus:

1. Minimizes smoke damage to the building.
2. Protects firefighting personnel.
3. Helps save lives of the building's occupants.
4. Minimizes death and injuries due to smoke and toxic gases.
5. Helps prevent the fire from spreading.
6. Enhances the ability to quickly extinguish the fire.
7. Cools the temperature of the building structure.
8. Improves the visibility in the area surrounding the fire to help occupants out of the building and permit firemen to view and fight the fire.
9. Simple to manufacture.
10. Easy to install and use.
11. Safe.
12. Economical.
13. Efficient.
14. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A firefighting process, comprising the steps of:

positioning a water spray nozzle in general alignment with an opening of a door or window of a burning building at a location spaced from a fire within the interior of the burning building so that said water spray faces substantially away from said fire towards the outside of the burning building;

said nozzle being attached to a smoke eliminator apparatus having a substantially rigid, elongated tube;

said tube being mounted outside and along the exterior wall of said building;

feeding water generally upwardly through said tube;

supplying said water to said nozzle in said opening of said door or window in said burning building;

substantially minimizing smoke damage to the interior of said building and substantially decreasing the amount and concentration of smoke in the burning building which might otherwise impair the vision of firemen fighting the fire in the burning building by creating a substantial suction and negative pressure at the opening of said door or window of said burning building; while concurrently injecting and spraying said water out of said nozzle in said opening of said door or window of said burning building in a direction substantially opposite and away from the fire;

said water being sprayed from said nozzle out of said opening in a direction away from the interior of the burning uilding into an area outside of said burning building;

removing a substantial amount of said smoke through the opening of said door or window of said burning building under said suction and negative pressure along with said water spray; and discharging the removed smoke into the surrounding atmosphere outside of the burning building.

2. A process in accordance with claim 1 wherein said apparatus has a generally U-shaped neck with at least one downwardly extending spike and said spike is driven into a ledge of the opening to mount said apparatus in a substantially stationary position with said nozzle facing away from the interior of the burning building.

3. A process in accordance with claim 2 including breaking a window about an opening with said neck before positioning said nozzle and mounting said apparatus.

4. A process in accordance with claim 2 wherein said water is directed toward the interior of the burning building through a lower portion of said neck before the water is injected away from the interior of the burning building through said nozzle.

5. An apparatus for help removing smoke from a burning building, comprising:

an elongated conduit for positioning generally upwardly along an axis;

a generally C-shaped tubular neck connected to and communicating with said conduit;

an outlet nozzle operatively connected to said neck above said conduit;

said nozzle having a spray head facing in a direction generally transverse to said axis; and a mounting bar having at least one pointed spike extending downwardly from said neck for substantially penetrating and securely engaging a window ledge or door sill of a burning building.

6. An apparatus for help removing smoke from a burning building, comprising:

a substantially upright, elongated, rigid pipe extending along a longitudinal axis, said pipe having a manually grippable portion for positioning said pipe substantially upwardly along an exterior wall of a burning building, an upper attached portion, and a lower portion with an internally threaded female coupling for receiving a hose operatively connected to a water supply;

a generally C-shaped, rigid tubular neck connected to and communicating with said upper attached portion of said upright pipe and substantially through an opening of a window or door of said burning building, said C-shaped tubular neck having a substantially extending horizontal lower arm extending radially inwardly from said upper attached portion of said upright pipe with an inward portion and an underside positioned adjacent a support surface comprising a sill selected from the group consisting of a window ledge and doorsill positioned adjacent said opening, a bight having an upper bight portion and a lower bight portion connected to and communicating with said inward portion of said lower arm, said bight having a convex exterior surface facing the interior of said burning building and a concave inner surface facing towards the outside of said burning building and spaced inwardly of said opening of said burning building, and said C-shaped tubular neck having a substantially horizontal upper arm positioned at a height above said upright elongated pipe, said upper arm having an inward portion connected to and communicating with said upper portion of said bight and having an outer nozzle-engaging portion spaced radially inwardly and offset from said longitudinal axis; and an outlet spray fog nozzle having an annular coupling connected to and communicating with said outer nozzle-engaging portion of said upper arm of said C-shaped tubular neck, an intermediate portion connected to said annular coupling, an outwardly flared, diverging annular spray head connected to and extending outwardly from said intermediate portion, and facing outwardly away from said burning building, and a generally upright foraminous face positioned concentrically inwardly of said spray head, said face of said nozzle being spaced radially inwardly of and offset from said longitudal axis and positioned in substantial vertical alignment with said opening or said burning building, and said foraminous face defining a set of apertures providing fluid flow outlet passageways for spraying a mist of water in an outwardly diverging spray pattern exteriorly away from said opening of said burning building to remove and discharge a substantial amount of smoke from said burning building through said opening of said burning building.

7. An apparatus in accordance with claim 6 including a generally n-shaped mounting bar extending downwardly from and connected to the underside of said lower arm of said C-shaped tubular neck for supporting said lower arm upon said support surface, said mounting bar having an upper lower pair of downwardly extending pointed spikes positioned on transversely opposite sides of said lower arm with at least one of said spikes engaging and penetrating a portion of said support surface to detachably mount said apparatus to said burning building.

* * * * *